US012692691B2

(12) United States Patent
Xu

(10) Patent No.: US 12,692,691 B2
(45) Date of Patent: Jul. 28, 2026

(54) TOILET SPRAY WASHING DEVICE AND SMART TOILET

(71) Applicant: INTONIC (EUROPE), LDA, Lisbon (PT)

(72) Inventor: Yixian Xu, Wenzhou (CN)

(73) Assignee: INTONIC (EUROPE), LDA, Lisbon (PT)

( * ) Notice: Subject to any disclaimer, the term of this patent is extended or adjusted under 35 U.S.C. 154(b) by 81 days.

(21) Appl. No.: 19/006,330

(22) Filed: Dec. 31, 2024

(65) Prior Publication Data

US 2026/0110163 A1 Apr. 23, 2026

(30) Foreign Application Priority Data

Oct. 18, 2024 (CN) ..... 202411463229.9

(51) Int. Cl.
*E03D 9/08* (2006.01)

(52) U.S. Cl.
CPC ..... *E03D 9/08* (2013.01)

(58) Field of Classification Search
CPC ..... E03D 9/08; E03D 11/06; A47K 3/26
See application file for complete search history.

(56) References Cited

U.S. PATENT DOCUMENTS 9,044,533 B2 * 6/2015 Shi ..... E03D 9/08
9,957,704 B2 * 5/2018 Gupta ..... E03D 9/08
2002/0042946 A1 * 4/2002 Jeon ..... E03D 9/08 4/420.4
2013/0042400 A1 * 2/2013 Ji ..... E03D 9/08 4/443
2015/0233105 A1 * 8/2015 Slothower ..... E03D 9/085 4/448
2016/0053474 A1 * 2/2016 Defu ..... B05B 1/14 239/589
2023/0349140 A1 11/2023 Lee et al.

FOREIGN PATENT DOCUMENTS

CN 213773666 U 7/2021
CN 217150517 U 8/2022
CN 218933343 U 4/2023

* cited by examiner

*Primary Examiner* — Christine J Skubinna

(57) ABSTRACT

A toilet spray washing device includes a nozzle cover and a base, both of which can be fixed detachably; the nozzle cover includes a first water outlet hole; the base includes a substrate and a base column; the base column includes a first spray washing mechanism, which includes a first inlet passage, a fixed groove connected to the other end of the first water inlet passage, a sealing element, an aerator for mixing water with air, an air intake hood nested inside the aerator, a water inlet port nested inside the air intake hood, and a screw; the aerator includes an aerating air intake hole for sucking in air and a first water outlet part. The aerator causes the first water outlet hole to spray a water-air mixture by mixing the water from the water inlet port with the air sucked in.

18 Claims, 8 Drawing Sheets

TOILET SPRAY WASHING DEVICE AND SMART TOILET

CROSS-REFERENCE TO RELATED APPLICATIONS

The present disclosure is based upon and claims the priority to Chinese patent application No. 202411463229.9, filed on Oct. 18, 2024 and entitled "TOILET SPRAY WASHING DEVICE AND SMART TOILET", which is incorporated herein by reference in their entirety.

TECHNICAL FIELD

The present disclosure relates to the field of smart toilets, specifically to a toilet spray washing device and a smart toilet.

BACKGROUND

With the development of society, more and more people begin to use smart toilets provided with a toilet spray washing device. A toilet spray washing device is often used to provide hip washing and/or feminine washing functions; hip washing means cleaning the hip by rinsing with warm water and drying with warm air; feminine washing is a function exclusively designed for women, usually emphasizing the care for their special parts.

To improve the feminine washing effect and the comfort of users, existing smart toilets generally use an air pump to mix air with water in the toilet spray washing to form an air-filled water column, thereby improving the cleaning effect. However, the use of an air pump not only increases the production costs, but also to some extent increases users' usage costs.

SUMMARY

To find a solution to better spray washing effects, the present disclosure provides a toilet spray washing device and a smart toilet.

Solution 1

A toilet spray washing device comprising a nozzle cover and a base, both of which are fixed detachably; the nozzle cover comprises a first water outlet hole; the base comprises a substrate and a base column, and the base column is formed by extending the first predetermined distance from the inner side surface of the substrate in the direction close to the side surface of the first water outlet hole on the nozzle cover; the base column comprises a first spray washing mechanism adapted to the first water outlet hole;

the first spray washing mechanism comprises a first water inlet passage connected to an external water source at one end, a fixed groove connected to the other end of the first water inlet passage, a sealing element located at the bottom of the fixed groove, an aerator for mixing water with air, an air intake hood nested inside the aerator, a water inlet port fitted into the air intake hood and connected to the first water inlet passage through the fixed groove, and a screw for fixing the water inlet port, air intake hood and aerator to the fixed groove and forming a screw air intake passage with the aerator, wherein the screw air intake passage is connected to the air; the aerator comprises an aerating air intake hole for sucking in air and a first water outlet part adapted to the first water outlet hole. The aerator causes the first water outlet hole to spray a water-air mixture by mixing the water from the water inlet port with the air sucked in by the aerating air intake hole.

Preferably, the first water outlet part comprises with at least one water outlet adapted to the first water outlet hole, and the water-air mixture is sprayed out through the water outlets and the first water outlet hole.

Preferably, the water inlet port, the air intake hood and the aerator are flush at the root, and the sealing element is assembled between the fixed groove and the root of the water inlet port, the air intake hood and the aerator.

Preferably, the water inlet port comprises a water inlet connected to the first water inlet passage through the fixed groove; the aerator causes the first water outlet hole to spray the water-air mixture by mixing the water from the water inlet port with the air sucked in by the aerating air intake hole.

Preferably, the water inlet port comprises a water inlet root, a water inlet top that is sealed at a top, located in a middle of the water inlet root and connected to the water inlet root, and a water inlet horizontal connection part for connecting the water inlet root and the water inlet top; the water inlet is located at a junction between the water inlet top and the water inlet horizontal connection part.

Preferably, the air intake hood comprises an air intake root, an air intake top that is open at a top and located in a middle of the air intake root and connected to the air intake root, and an air intake horizontal connection part for connecting the air intake root and the air intake top; a diameter of the air intake root is larger than a diameter of the water inlet root; a diameter of the air intake top is larger than a diameter of a corresponding air intake top; a diameter of the air intake horizontal connection part is larger than a diameter of the water inlet horizontal connection part.

Preferably, a height of the air intake top is smaller than a height of the water inlet top.

Preferably, the aerator comprises an aerating root, an aerating top located in a middle of the aerating root and connected to the aerating root, and an aerating horizontal connection part for connecting the aerating root and the aerating top; the first water outlet part is located at a top of the aerating top, and the aerating air intake hole is located at a bottom of the aerating top and in contact with the aerating horizontal connection part.

Preferably, a diameter of the aerating root is larger than a diameter of the air intake root; a diameter of the aerating top is larger than a diameter of the air intake top; a diameter of the aerating horizontal connection part is larger than a diameter of the air intake horizontal connection part, and a height of the aerating top is larger than a height of the air intake top.

Solution 2

A smart toilet comprising an expansion device and a toilet spray washing device as described in the Solution 1 and the toilet spray washing device is located at the front end of the expansion device and constitutes the water outlet terminal of the expansion device.

Compared with prior art, the toilet spray washing device and the smart toilet provided by the present disclosure have the following beneficial effects:

The present disclosure of toilet spray washing device and smart toilet introduces an aerator to mix water with air and generate bubbly water, which not only significantly reduces production costs and users' usage costs, but also effectively improves user experience.

Additional aspects and advantages of the present disclosure will be partially presented in the description below, and will become apparent from the description below, or will be learned through practice related to the present disclosure.

BRIEF DESCRIPTION OF THE DRAWINGS

The above and/or additional aspects and advantages of the present disclosure will be obvious and understandable from the following description of the embodiments through the use of the accompanying drawings, in which.

Figure 1:
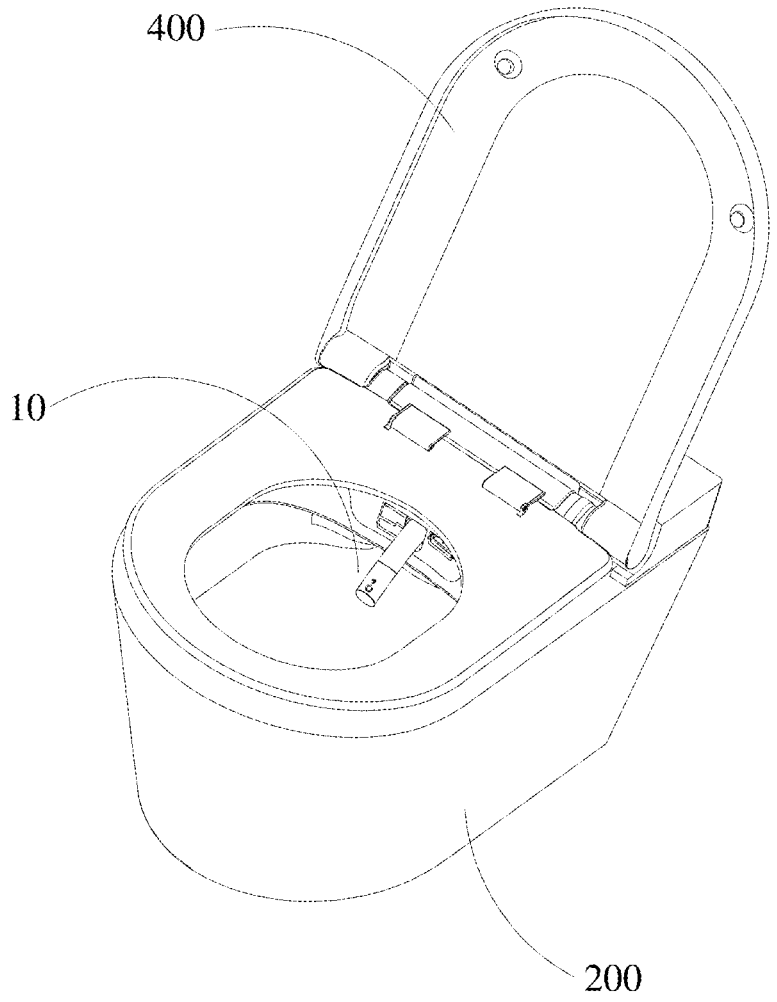
FIG. 1 is a schematic view of an application scenario of an embodiment of the present disclosure toilet spray washing device.

The part names and their reference signs in the drawings are as follows:

200. Toilet bowl; 400. Toilet lid; 600. Load tank;

10. Cleaning mechanism; 103. Expansion device; 1031. Sleeve; 1033. Connection mechanism; 1035. First water inlet pipe; 1037. Second water inlet pipe;

101. Toilet spray washing device;

1011. Nozzle cover; 1013. First water outlet hole; 1015. second water outlet hole; 1017. Buckle hole; 1019. Bearing plummer;

1012. Base; 1014. Substrate; 1016. Base column;

80. First spray washing mechanism; 801. First water inlet passage; 803. Fixed groove; 8031. Carrier; 8033. Nut groove; 802. Sealing element; 804. Water inlet port; 8041. Water inlet root; 8043. Water inlet top; 8045. Water inlet; 8047. Water inlet horizontal connection part; 806. Air intake hood; 8061. Air intake root; 8063. Air intake top; 8065. Air intake horizontal connection part; 808. Aerator; 8081. Aerating root; 8083. Aerating top; 8085. First water outlet part; 8087. Aerating air intake hole; 8088. Water outlet; 8089. Aerating horizontal connection part; 810. Screw; 8101. Thread; 8103. Convex screw stud; 8000. Screw air intake passage;

90. Second spray washing mechanism; 901. Second water inlet passage; 903. Second water outlet.

DETAILED DESCRIPTION OF EMBODIMENTS

To enable personnel in this technical field to better understand the purpose, technological solutions and advantages of the present disclosure, detailed description of the present disclosure will be provided with reference to the accompanying drawings and embodiments. It should be understood that the specific embodiments described herein are only for explaining about the present disclosure, rather than for limiting the present disclosure.

It should be noted that when a component is referred to as "fixed to" another component, it can be directly on the other component or there can be an intermediate component located between them. When a component is considered to be "connected" to another component, it can be directly connected to another component or there may be an intermediate component located between them. In addition, 'A adapted to B' indicates that B is associated with A, and B can be identified based on A. However, it should also be understood that identifying B based on A does not mean identifying B solely based on A, and B can also be identified based on A and/or other information. For the purpose of the present disclosure, the terms "upper", "lower", "left", "right", "front", "rear", "top", "bottom", "inner", "outer", "center", "vertical", "horizontal", "transverse", "longitudinal" and the like are used to indicate the orientation or positional relationship shown in the accompanying drawings, merely for convenience and simplification of the description,, rather than to indicate or imply that the device or component must have a specific orientation, or be constructed and operated in a specific orientation. Besides being used to represent orientation or positional relationships, some of the aforementioned terms may also be used to represent other meanings. For example, the term 'upper' can be used on some occasions to represent some kind of attachment or connection. Ordinary technical personnel in this field may understand the specific meanings of these terms in the present disclosure as the case may be. In addition, the terms "installed", "located", "provided with", "connected", and "interconnected" shall be understood in broad sense, which may, for example, refer to fixed connection, detachable connection or integral connection; may refer to mechanical connection or electrical connection; and may refer to direct connection, indirect connection through an intermediate medium, or internal connection between two devices, components or constituents. A person of ordinary skill in the art can understand the specific meaning of the terms in the present disclosure according to specific situations. In regard to the embodiments provided by the present disclosure, it should be understood that the term "one embodiment" that appears throughout the specification means that specific features, structures or characteristics related to the embodiment are included in at least one embodiment of the present disclosure. Therefore, the term "in one embodiment" or "in some embodiments" that appears throughout the specification may not necessarily refer to the same embodiment. In addition, these specific features, structures or characteristics may be combined in any suitable manner in one or more embodiments. Technical staff in the art should also be aware that the embodiments described in the specification are optional, and the parts or components involved are not necessarily essential for the present disclosure.

Figure 2:
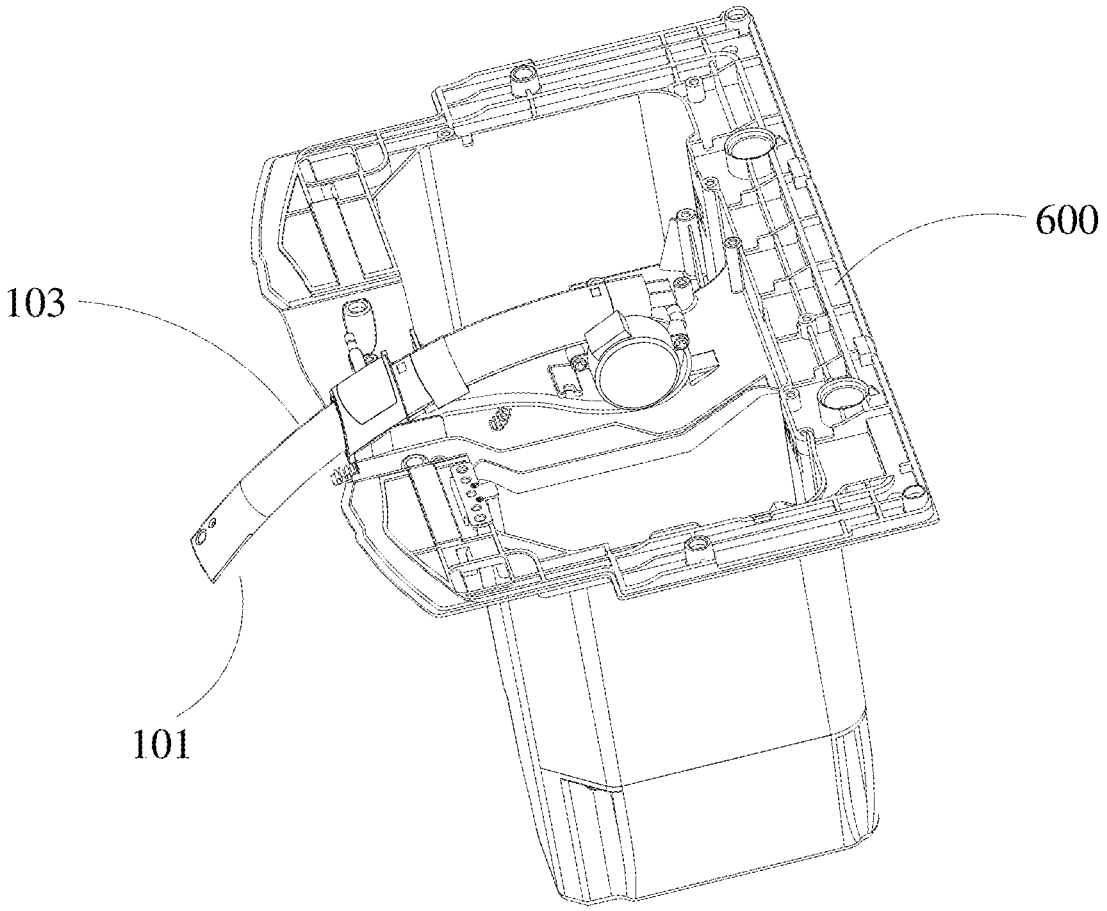
FIG. 2 is a structural view of the assembly of the cleaning mechanism in the application scenario of an embodiment of the present disclosure-toilet spray washing device.
Figure 3:
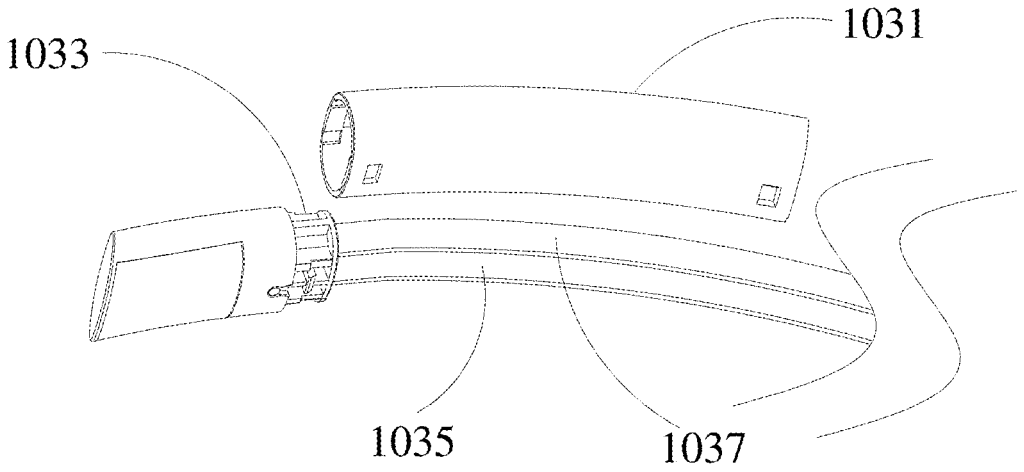
FIG. 3 is a structural view of the cooperation between the toilet spray washing device and the expansion device in the application scenario of an embodiment of the present disclosure-toilet spray washing device.
Figure 4:
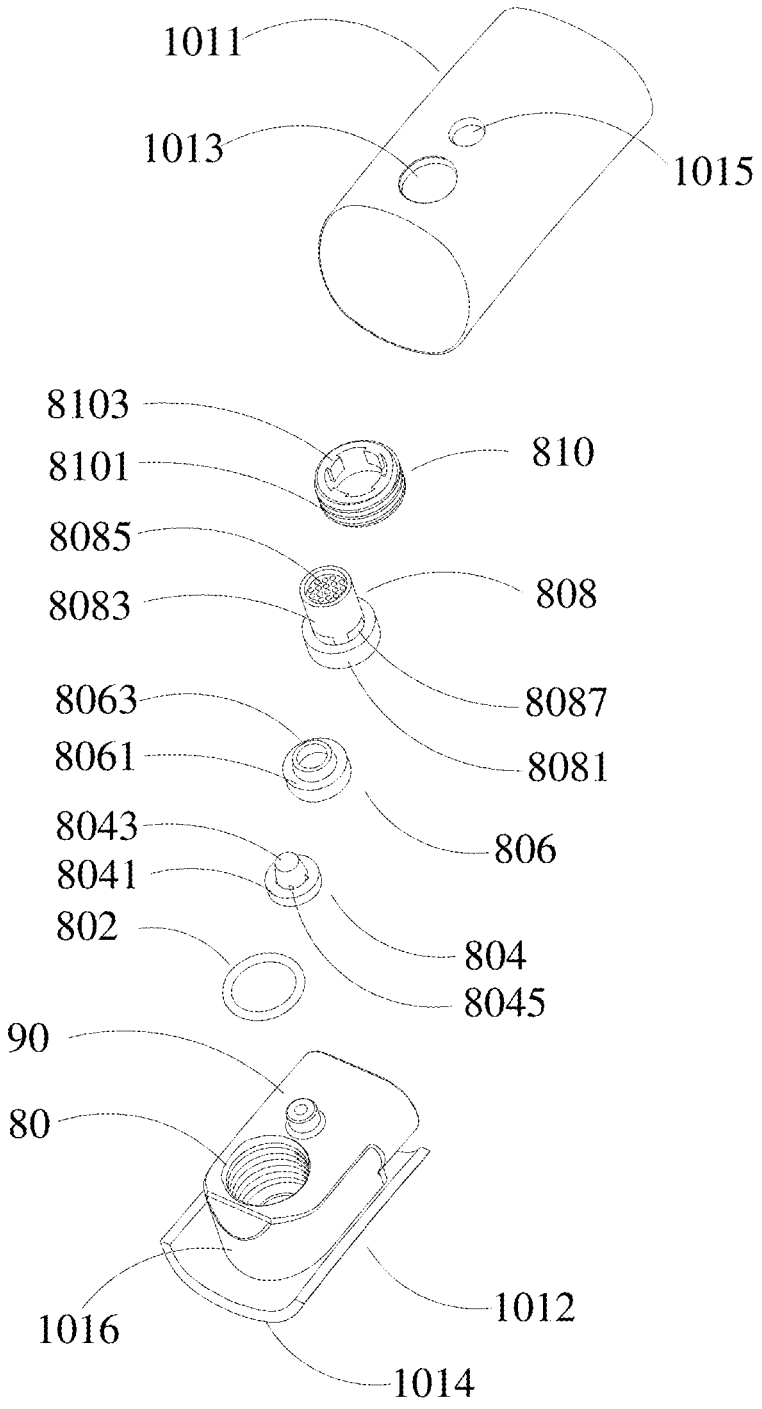
FIG. 4 is a structural view of the explosion of an embodiment of the present disclosure-toilet spray washing device.
Figure 5:
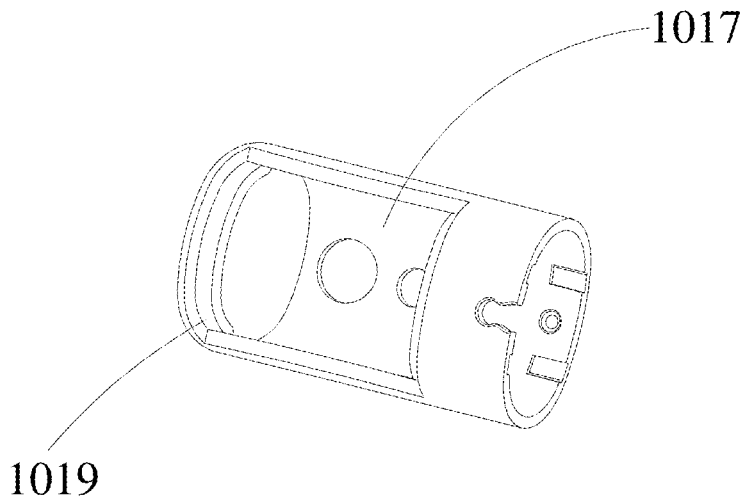
FIG. 5 is a structural view of the nozzle cover in an embodiment of the present disclosure-toilet spray washing device.
Figure 6:
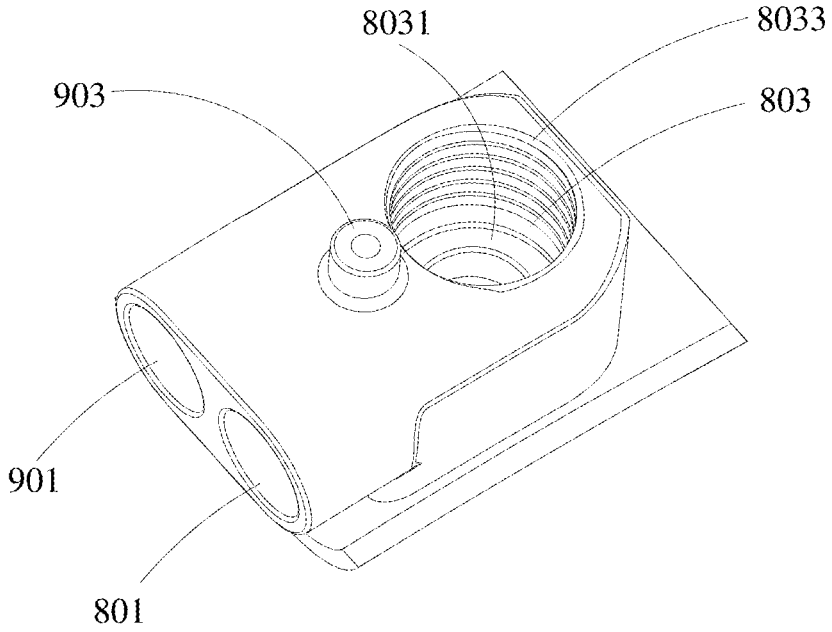
FIG. 6 is a structural view of the base of an embodiment of the present disclosure-toilet spray washing device.
Figure 7:
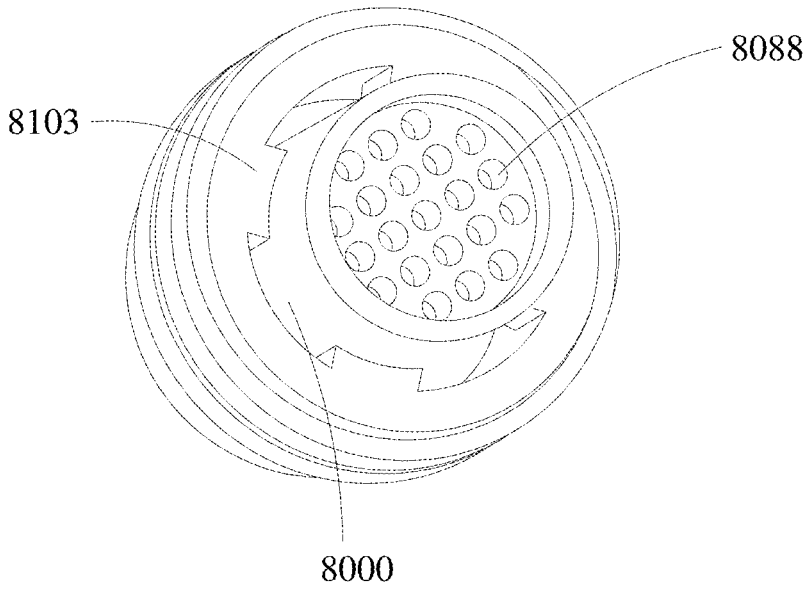
FIG. 7 is a structural view of the assembly of an aerator and a screw in an embodiment of the present disclosure-toilet spray washing device.
Figure 8:
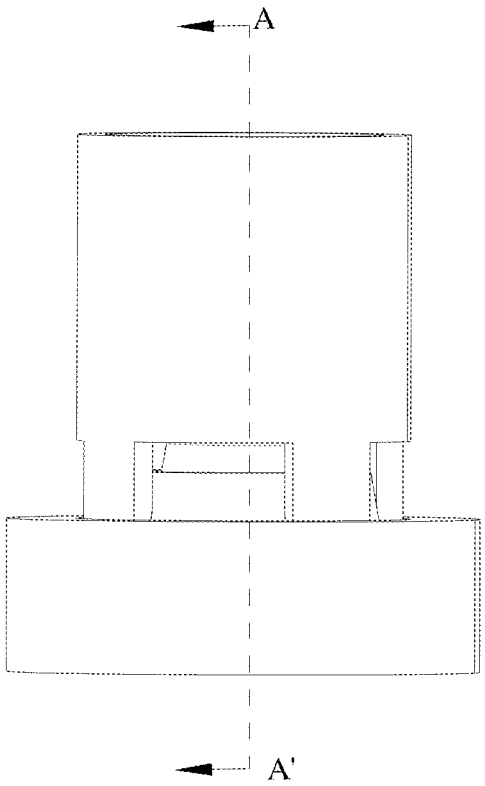
FIG. 8 is a structural view of the assembly of a water inlet port, an air intake hood and an aerator in an embodiment of the present disclosure-toilet spray washing device.
Figure 9:
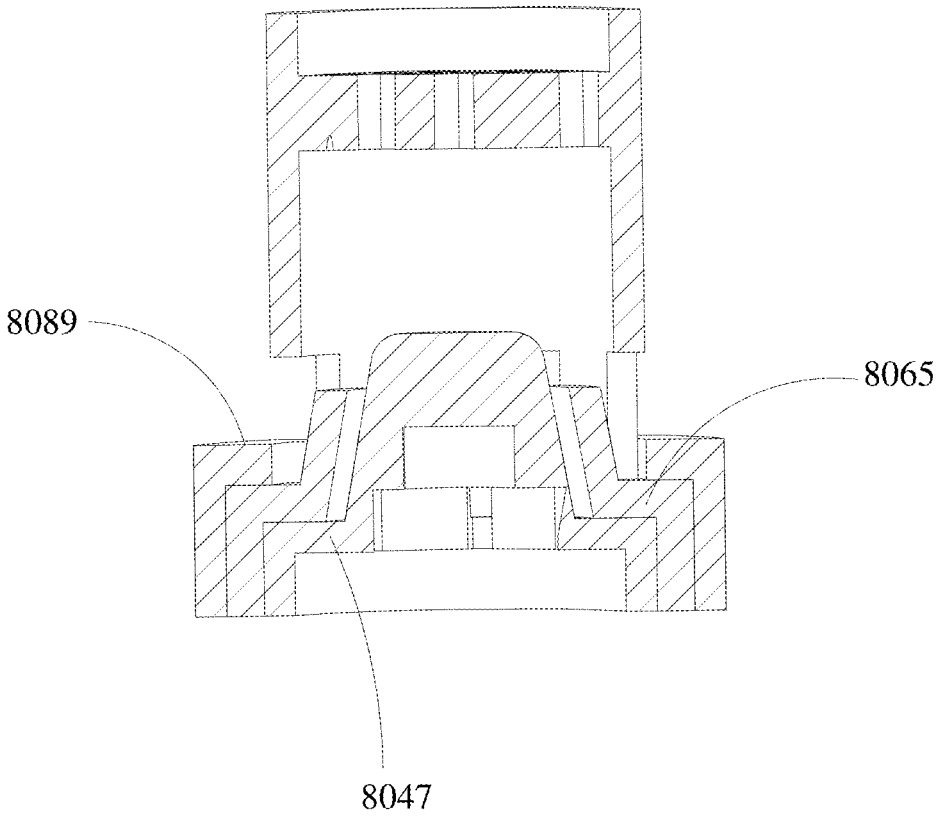
FIG. 9 is a structural view of the cross-section along the A-A' direction of FIG. 8.

Referring to FIGS. 1 to 3, in the embodiment of the present disclosure, a toilet spray washing device is applied in a smart toilet cleaning scenario. FIGS. 1-3 illustrate an application scenario of a toilet spray washing device in an embodiment of the present disclosure. As shown in FIGS. 1-3, a smart toilet comprises a toilet bowl 200, a toilet lid 400 hinged to the toilet bowl 200, a load tank 600 mounted on the toilet bowl 200, and a cleaning mechanism 10 fixed to the loan tank 600, wherein:

The cleaning mechanism 10 comprises a toilet spray washing device 101, an expansion device 103 for driving the toilet spray washing device 101 to expand and contract, and an electric control module for controlling the expansion device 103. The cleaning mechanism 10 is fixed to the load tank 600 through the rear end of the expansion device 103. The toilet spray washing device 101 is fixed at the front end of the expansion device 103;

The expansion device 103 comprises a sleeve 1031, a connecting mechanism 1033, a first water inlet pipe 1035, and a second water inlet pipe 1037. Among them, the connecting mechanism 1033 is detachably fixed at one end to the sleeve 1031, and the other end detachably fixed to the toilet spray washing device 101; the first water inlet pipe 1035 and the second water inlet pipe 1037 are respectively connected at one end to an external water source, and the other end to the toilet spray washing device 101 through the connecting mechanism 1033.

To better describe the embodiment of the present disclosure-toilet spray washing device, the smart toilet application scenario shown in FIGS. 1-3 is taken as an example for description. It should be understood that this description involves only one application scenario of the embodiment of the present disclosure-toilet spray washing device, and should not be understood as a limitation on the embodiment of the present disclosure-toilet spray washing device.

Referring to FIGS. 4 to 9, in the embodiment of the present disclosure, a toilet spray washing device comprises a nozzle cover 1011 and a base 1012, both of which are fixed detachably.

In some embodiments, the nozzle cover 1011 has an elliptical cross-section and is a hollow cavity with one end sealed. The toilet spray washing device 101 is detachably fixed to the other end of the connecting mechanism 1033 through the nozzle cover 1011.

In some embodiments, the nozzle cover 1011 comprises a first water outlet hole 1013, a second water outlet hole 1015, and a buckle hole 1017, wherein the first water outlet hole 1013 and the second water outlet hole 1015 are located on one side surface of the nozzle cover 1011; the buckle hole 1017 is located on the side surface opposite to the first water outlet hole 1013 and the second water outlet hole 1015, and is adapted to the first water outlet hole 1013 and the second water outlet hole 1015. The two ends of the buckle hole 1017 are provided with a bearing plummer 1019, and the nozzle cover 1011 is detachably fixed to the base 1012 through the bearing plummer 1019.

In some embodiments, the bearing plummer 1019 is formed by extending the edges of the two ends of the buckle hole 1017 towards the cavity of the nozzle cover 1011 by a first prefabricated distance, and then horizontally by a second prefabricated distance in the opposite direction. The cross-sections of the first water outlet hole 1013 and the second water outlet hole 1015 are both circular, and a radius of the first water outlet hole 1013 is larger than a radius of the second water outlet hole 1015. The cross-section of the buckle hole 1017 is arc-shaped.

The base 1012 includes a substrate 1014, wherein the cross-section of the substrate 1014 is arc-shaped and adapted to the buckle hole 1017. The nozzle cover 1011 and the base 1012 are detachably fixed to the substrate 1014 through the buckle hole 1017.

In some embodiments, for ease of disassembly, the nozzle cover 1011 is detachably fixed to the substrate 2012 in a way that the substrate 1014 and the buckle hole 1017 allow for clipping in and out through deformation.

The base 1012 also comprises a base column 1016, a first spray washing mechanism 80 adapted to the first water outlet hole 1013, and a second spray washing mechanism 90 adapted to the second water outlet hole 1015, wherein, the base column 1016 is formed by extending a first predetermined distance from the inner side surface of the substrate 1014 in a direction close to the side surface of the nozzle cover 1011 where the first water outlet hole 1013 and the second water outlet hole 1015 are located; the first spray washing mechanism 80 and the second spray washing mechanism 90 are located inside the base column 1016 and are independent of each other.

In some embodiments, the first spray washing mechanism 80 is used for feminine washing. The second spray washing mechanism 90 is used for hip washing.

The first spray washing mechanism 80 comprises a first water inlet passage 801 connected to an external water source at one end, and a fixed groove 803 connected to the other end of the first water inlet passage 801, wherein, the fixed groove 803 comprises a carrier 8031 and a nut groove 8033, wherein one end of the nut groove 8033 is adjacent to the first water outlet hole 1013; the carrier 8031 is located at the bottom of the fixed groove 803 and close to the other end of the nut groove 8033.

In some embodiments, one end of the first water inlet passage 801 is connected to an external water source through the connecting mechanism 1033 and the first water inlet pipe 1035.

In some embodiments, the first spray washing mechanism 80 also comprises a sealing element 802 located at the bottom of the fixed groove 803, an aerator 808 for mixing water with air, an air intake hood 806 nested inside the aerator 808, a water inlet port 804 nested inside the air intake hood 806 and connected to the first water inlet passage 801 through the fixed groove 803, and a screw 810 for fixing the water inlet port 804, the air intake hood 806 and the aerator 808 onto the fixed groove 803, wherein the water inlet port 804, the air intake hood 806 and the aerator 808 are flush at the root and the sealing element 802 is assembled between the fixed groove 803 and the root of the water inlet port 804, the air intake hood 806 and the aerator 808; the screw 810 is wrapped around the aerator 808; the aerator 808 is screwed into the fixed groove 803 through a screw 810 and a nut groove 8033.

In some embodiments, the seal 802 is an O-ring or gasket. Seal 802 is assembled between the carrier 8031 of the fixed groove 803 and the root of the water inlet port 804, the air intake hood 806 and the root of the aerator 808.

The inlet port 804 is generally convex-shaped, and comprises a water inlet root 8041, a water inlet top 8043 with a sealed top and located in the middle of the water inlet root 8041 and connected to the water inlet root 8041, a water inlet horizontal connection part 8047 with a circular cross-section for connecting the water inlet root 8041 and the water inlet top 8043, and a water inlet 8045 connected to the first water inlet passage 801 through a fixed groove 803, wherein the water inlet root 8041 is column-shaped, and the water inlet top 8043 is shaped like a cylinder. A diameter of the water inlet top 8043 is smaller than a diameter of the water inlet root 8041; the water inlet 8045 is located at the junction between the water inlet top 8043 and the water inlet horizontal connection part 8047.

In some embodiments, there are five water inlets 8045, which are evenly distributed along the circumference of the connection between the water inlet top 8043 and the water inlet horizontal connection part 8047.

The air intake hood 806 is generally convex-shaped, and comprises an air intake root 8061, an air intake top 8063 with an open top and located in the middle of the air intake root 8061 and connected to the air intake root 8061, and an air intake horizontal connection 8065 with a ring-shaped cross-section for connecting the air intake root 8061 and the air intake top 8063. The air intake root 8061 is cylinder-shaped, the intake top 8063 is shaped like a cylinder, and a diameter of the air intake top 8063 is smaller than a diameter of the air intake root 8061; a diameter of the air intake root 8061 is larger than a diameter of the water inlet root 8041; a diameter of the air intake top 8063 is larger than a diameter of the corresponding water inlet top 8043; a diameter of the air intake horizontal connection part 8065 is larger than a diameter of the water inlet horizontal connection part 8047.

In some embodiments, a height of the air intake top 8063 is smaller than a height of the water inlet top 8043.

The aerator 808 is generally convex-shaped, and comprises an aerating root 8081, an aerating top 8083 located in the middle of the aerating root 8081 and connected to the aerating root 8081, an aerating horizontal connection part 8089 with a ring-shaped cross-section for connecting the aerating root 8081 and the aerating top 8083, a first water outlet part 8085 located at the top of the aerating top 8083 and adapted to the first water outlet hole 1013, and an aerating air intake hole 8087, wherein the aerating root 8081 is column-shaped, the aerating top 8083 is cylinder-shaped, and a diameter of the aerating top 8083 is smaller than a diameter of the aerating root 8081; a diameter of the aerating root 8081 is larger than a diameter of the air intake root 8061; a diameter of the aerating top 8083 is larger than a diameter of the air intake top 8063; a diameter of the aerating horizontal connection part 8089 is larger than a diameter of the air intake horizontal connection part 8065; a height of the aerating top 8083 is larger than that of the water inlet top 8043; the first water outlet part 8085 is located at the top of the aerating top 8083 and is equipped with a water outlet 8088 adapted to the first water outlet hole 1013; the aerating air intake hole 8087 is located at the bottom of the aerating top 8083 and contacts the aerating horizontal connection part 8089.

In some embodiments, there are twenty-one water outlets 8088 arranged uniformly on the first water outlet part 8085.

In some embodiments, there are four aerating air intake holes 8087 evenly distributed along the circumference of the bottom of the aerating top 8083 and in contact with the aerating horizontal connection part 8089.

In this way, the aerator 808 can mix the water from the water inlet port 804 with the air sucked in by the aerating air intake port 8087 so that the mixture of air and water can be sprayed out through the water outlet port 8088 and the first water outlet hole 1013.

The screw 810 has a cylinder-shaped cross-section and comprises thread 8101, convex screw stud 8103 for clamping the aerating top 8083, and screw air intake passage 8000 connected to the aerating air intake hole 8087, wherein thread 8101 is located on the outside of screw 810 and is adapted to nut groove 8033; convex screw stud 8103 is located inside screw 810.

In some embodiments, there are four convex screw studs 8103 evenly distributed along the circumference of the inner side surface of screw 810. Screw air intake passage 8000 is an open cavity surrounded by two convex screw studs 8103 and an aerating top 8083. In this wayexternal air can enter the interior of the aerator 808 through the screw air intake passage 8000 and the aerating air intake hole 8087 and then participate in water and air mixing process.

In some embodiments, the bottom end of screw 810 is in contact with the aerating horizontal connection part 8089 of aerator 808.

Second spray washing mechanism 90 comprises a second water inlet passage 901 connected to an external water source at one end, and a second water outlet 903 adapted to the second water outlet hole 1015, wherein the other end of the second water inlet passage 901 is connected to the second water outlet 903.

In some embodiments, one end of second water inlet passage 901 is connected to an external water source through connecting mechanism 1033 and second water inlet pipe 1037.

To better understand the embodiment of the present disclosure-toilet spray washing device, the first spray washing mechanism 80 will be taken as an example to outline its specific working principle of cleaning. This example can also be referenced in the understanding of the second spray washing mechanism 90. Therefore, no further example will be given as to the second spray washing mechanism 90:

When it is necessary to use the embodiment of the present disclosure-toilet spray washing device, the first spray washing mechanism 80 will divert water into water inlet port 804 through the first water inlet passage 801. Next, water inlet port 804 diverts water into air intake hood 806 through water inlet 8045. At this point, water will collide with the inner wall of air intake hood 806, spray into aerator 808, and collide with its wall to atomize the clean water into water ions. At the same time, due to the Venturi effect, the air in the atmosphere will enter aerator 808 through screw air intake passage 8000 and aerating air intake hole 8087. In this way, the atomized water ions can be mixed with air to generate a water-air mixture, i.e. bubbly water, which can be sprayed out through first water outlet hole 1013 and used for gentle cleaning and massage of women's private parts.

Compared with the prior art, the embodiment of the present disclosure-toilet spray washing device provides the following beneficial effects:

The embodiment of the present disclosure—toilet spray washing device introduces aerator 808 to mix water with air and generate bubbly water, which not only significantly reduces production costs and users' usage costs, but also effectively improves user experience.

Based on the same inventive concept as the embodiment of the present disclosure—a toilet spray washing device, another embodiment of the present disclosure provides a smart toilet comprising an expansion device and a toilet spray washing device described above, and the toilet spray washing device is located at the front end of the expansion device and constitutes the water outlet terminal of the expansion device.

In some embodiments, the expansion device is a spray bar.

It is worth noting that for another embodiment of the present disclosure—smart toilet, matters not covered herein shall be the same as the prior art or can be realized using the prior art, and therefore will not be repeated here.

Compared with the prior art, another embodiment of the present disclosure—a smart toilet provides the following beneficial effects:

Another embodiment of the present disclosure—a smart toilet introduces a toilet spray washing device equipped with aerator 808 to mix water with air and generate bubbly water, which not only significantly reduces production costs and users' usage costs, but also effectively improves user experience.

The above only constitutes part of the embodiments of the present disclosure. It should be noted that for a person of ordinary skill in the art, some improvements and embellishments can be made without deviating from the principles of the present disclosure, and these improvements and embellishments should also be considered to fall within the protection scope of the present disclosure.

What is claimed is:

1. A toilet spray washing device, comprising:

a nozzle cover and a base, both of which are fixed detachably;

wherein the nozzle cover comprises a first water outlet hole;

the base comprises a substrate and a base column, and the base column is formed by extending a first predetermined distance from an inner side surface of the substrate in a direction close to a side surface of the first water outlet hole on the nozzle cover;

the base column comprises a first spray washing mechanism adapted to the first water outlet hole; and the first spray washing mechanism comprises:

a first water inlet passage connected to an external water source at one end, a fixed groove connected to an other end of the first water inlet passage, a sealing element located at a bottom of the fixed groove, an aerator for mixing water with air, an air intake hood nested inside the aerator, a water inlet port nested inside the air intake hood and connected to the first water inlet passage through the fixed groove, and a screw for fixing the water inlet port, the air intake hood and the aerator to the fixed groove and forming a screw air intake passage with the aerator, wherein the screw air intake passage is connected to the air; and the aerator comprises an aerating air intake hole for sucking in air and a first water outlet part adapted to the first water outlet hole, the aerator causes the first water outlet hole to spray a water-air mixture by mixing the water from the water inlet port with the air sucked in by the aerating air intake hole.

2. The toilet spray washing device described in claim 1, wherein the first water outlet part comprises at least one water outlet adapted to the first water outlet hole, and the water-air mixture is sprayed out through the water outlet and the first water outlet hole.

3. The toilet spray washing device described in claim 2, wherein the water inlet port, the air intake hood and the aerator are flush at a root, and the sealing element is assembled between the fixed groove and the root of the water inlet port, the air intake hood and the aerator.

4. The toilet spray washing device described in claim 3, wherein the water inlet port comprises a water inlet connected to the first water inlet passage through the fixed groove; the aerator causes the first water outlet hole to spray the water-air mixture by mixing the water from the water inlet port with the air sucked in by the aerating air intake hole.

5. The toilet spray washing device described in claim 4, wherein the water inlet port comprises a water inlet root, a water inlet top that is sealed at a top, located in a middle of the water inlet root and connected to the water inlet root, and a water inlet horizontal connection part for connecting the water inlet root and the water inlet top; the water inlet is located at a junction between the water inlet top and the water inlet horizontal connection part.

6. The toilet spray washing device described in claim 5, wherein the air intake hood comprises an air intake root, an air intake top that is open at a top and located in a middle of the air intake root and connected to the air intake root, and an air intake horizontal connection part for connecting the air intake root and the air intake top; a diameter of the air intake root is larger than a diameter of the water inlet root; a diameter of the air intake top is larger than a diameter of a corresponding air intake top; a diameter of the air intake horizontal connection part is larger than a diameter of the water inlet horizontal connection part.

7. The toilet spray washing device described in claim 6, wherein a height of the air intake top is smaller than a height of the water inlet top.

8. The toilet spray washing device described in claim 6, wherein the aerator comprises an aerating root, an aerating top located in a middle of the aerating root and connected to the aerating root, and an aerating horizontal connection part for connecting the aerating root and the aerating top; the first water outlet part is located at a top of the aerating top, and the aerating air intake hole is located at a bottom of the aerating top and in contact with the aerating horizontal connection part.

9. The toilet spray washing device described in claim 8, wherein a diameter of the aerating root is larger than a diameter of the air intake root; a diameter of the aerating top is larger than a diameter of the air intake top; a diameter of the aerating horizontal connection part is larger than a diameter of the air intake horizontal connection part, and a height of the aerating top is larger than a height of the air intake top.

10. A smart toilet, comprising:

an expansion device; and the toilet spray washing device as described in claim 1, which is located at a front end of the expansion device and constitutes a water outlet terminal of the expansion device.

11. A smart toilet, comprising:

an expansion device; and the toilet spray washing device as described in claim 2, which is located at a front end of the expansion device and constitutes a water outlet terminal of the expansion device.

12. A smart toilet, comprising:

an expansion device; and the toilet spray washing device as described in claim 3, which is located at a front end of the expansion device and constitutes a water outlet terminal of the expansion device.

13. A smart toilet, comprising:

an expansion device; and the toilet spray washing device as described in claim 4, which is located at a front end of the expansion device and constitutes a water outlet terminal of the expansion device.

14. A smart toilet, comprising:

an expansion device; and the toilet spray washing device as described in claim 5, which is located at a front end of the expansion device and constitutes a water outlet terminal of the expansion device.

15. A smart toilet, comprising:

an expansion device; and the toilet spray washing device as described in claim 6, which is located at a front end of the expansion device and constitutes a water outlet terminal of the expansion device.

16. A smart toilet, comprising:

an expansion device; and the toilet spray washing device as described in claim 7, which is located at a front end of the expansion device and constitutes a water outlet terminal of the expansion device.

17. A smart toilet, comprising:

an expansion device; and the toilet spray washing device as described in claim 8, which is located at a front end of the expansion device and constitutes a water outlet terminal of the expansion device.

18. A smart toilet, comprising:

an expansion device; and the toilet spray washing device as described in claim 9, which is located at a front end of the expansion device and constitutes a water outlet terminal of the expansion device.

* * * * *